US005651502A

United States Patent [19]

Edwards

[11] Patent Number: 5,651,502

[45] Date of Patent: Jul. 29, 1997

[54] PRODUCE MISTER

[75] Inventor: Tim L. Edwards, Wilsonville, Oreg.

[73] Assignee: Mistech, Inc., Portland, Oreg.

[21] Appl. No.: 404,157

[22] Filed: Mar. 14, 1995

[51] Int. Cl.[6] ..... B05B 1/14

[52] U.S. Cl. ..... 239/450; 239/550; 239/557

[58] Field of Search ..... 239/550, 551, 239/556, 557, 562, 450; 312/115; 99/485–487, 516

[56] References Cited

U.S. PATENT DOCUMENTS

| | | | |
|---|---|---|---|
| 1,827,175 | 10/1931 | Taylor et al. | 312/115 |
| 2,625,806 | 1/1953 | Kennedy | 312/115 X |
| 4,808,303 | 2/1989 | Edwards et al. | 312/115 X |
| 4,914,339 | 4/1990 | Hayman | 137/177 |
| 4,925,097 | 5/1990 | Corrigan | 239/562 X |

*Primary Examiner*—Lesley D. Morris
*Attorney, Agent, or Firm*—Robert L. Harrington

[57] ABSTRACT

A produce mister for misting produce in a display case. The produce mister has a bar extending the width of the display case and has nozzles for dispensing water at selected intervals. The bar has a small diameter conduit that minimizes the water within the conduit and assures that all of the water within the conduit is dispensed through the nozzles during a mist cycle. Multiple branch water lines are interconnected to the bar to ensure a uniform flow of water to all of the nozzles. The bar is arranged to be coupled to another bar by a sealing coupling and a locating pin to provide a bar of extended length.

12 Claims, 2 Drawing Sheets

PRODUCE MISTER

FIELD OF THE INVENTION

This invention relates to apparatus for periodic misting of produce, e.g., in a grocery store and more particularly to a structure that performs more efficiently and is less costly to construct and install.

BACKGROUND OF THE INVENTION

A produce mister is used in grocery stores to maintain produce products at a desired dampness. It has been determined that produce that is kept moist will have a longer shelf life and a better appearance than if allowed to dry out. However, the use of misters has to be carefully controlled. Produce that is wet opposed to moist is not appealing and excess water will cause decay of the display cases and surrounding structure and breeds bacteria that is prohibited by code.

A typical misting pattern is the spraying of a fine mist for about ten seconds recurring about every ten minutes. In a 72 foot produce display with misting nozzles spaced at 18" intervals, the total consumption of water is about 0.4 gallons.

Prior art misters typically include a long bar that extends the length of the produce display case and has nozzles at spaced intervals along the length of the bar. A water line is attached to each end of the bar and a sufficient pressure is applied through each line to generate the desired misting action at the nozzles throughout the length of the misting bar. Typically the channel through the bar which carries the water is between about ½" ID (inside diameter) to about ⅝" ID. The amount of water that is required to fill such channels (extended 72 feet) ranges between about 0.85 gallons to 1.16 gallons of water. Whereas a typical misting cycle uses only 0.4 gallons in ten minutes, at least three misting cycles are required to purge the channel or alternatively the channel is repeatedly purged to waste. More importantly, the water flow through the channel of the bar and into and through the nozzles is erratic and areas of very slow flow are developed, i.e., certain of the fresh water flows over and past the water in the channel. Water may stay in the channel for long periods of time and become breeding ground for unwanted bacteria. This problem is aggravated by the proximity of the bar to the UV light which is mounted proximate to the bar in most produce display cases.

BRIEF DESCRIPTION OF THE PRESENT INVENTION

In the preferred embodiment of the present invention, the misting bar is provided with a 5/32" ID conduit which, at about 72 feet in length, holds just over 0.1 gallons of water. Thus, the same 0.4 gallon flow used in a single misting cycle will purge the bar conduit of the present invention several times during a single misting cycle. However, with the small conduit, pressure drop is a problem and the invention further calls for multiple water inlets to the conduit of the bar, e.g., at every 12 foot length of the bar. This requires a water supply line, e.g., a header line that feeds into the misting bar at 12 foot intervals.

Other advantages are provided by the structure of the bar. Sections of the bar are attached end to end using dowels (pins) and tube like couplings that interconnect the conduits, the couplings are provided with exterior grooves with O-rings in the grooves to seal between the bar sections. Thus, the various sections can be readily assembled just by pressing the ends of two sections together over the tube and dowel. Water taps into the bar conduit are provided by drilling a hole and press fitting a nipple into the hole, the nipple having exterior threads that provides for ready attachment to the water line or misting nozzles.

Other advantages and improvements will become apparent on reference to the following detailed description and drawings.

DESCRIPTION OF THE PREFERRED EMBODIMENT

Figure 1:
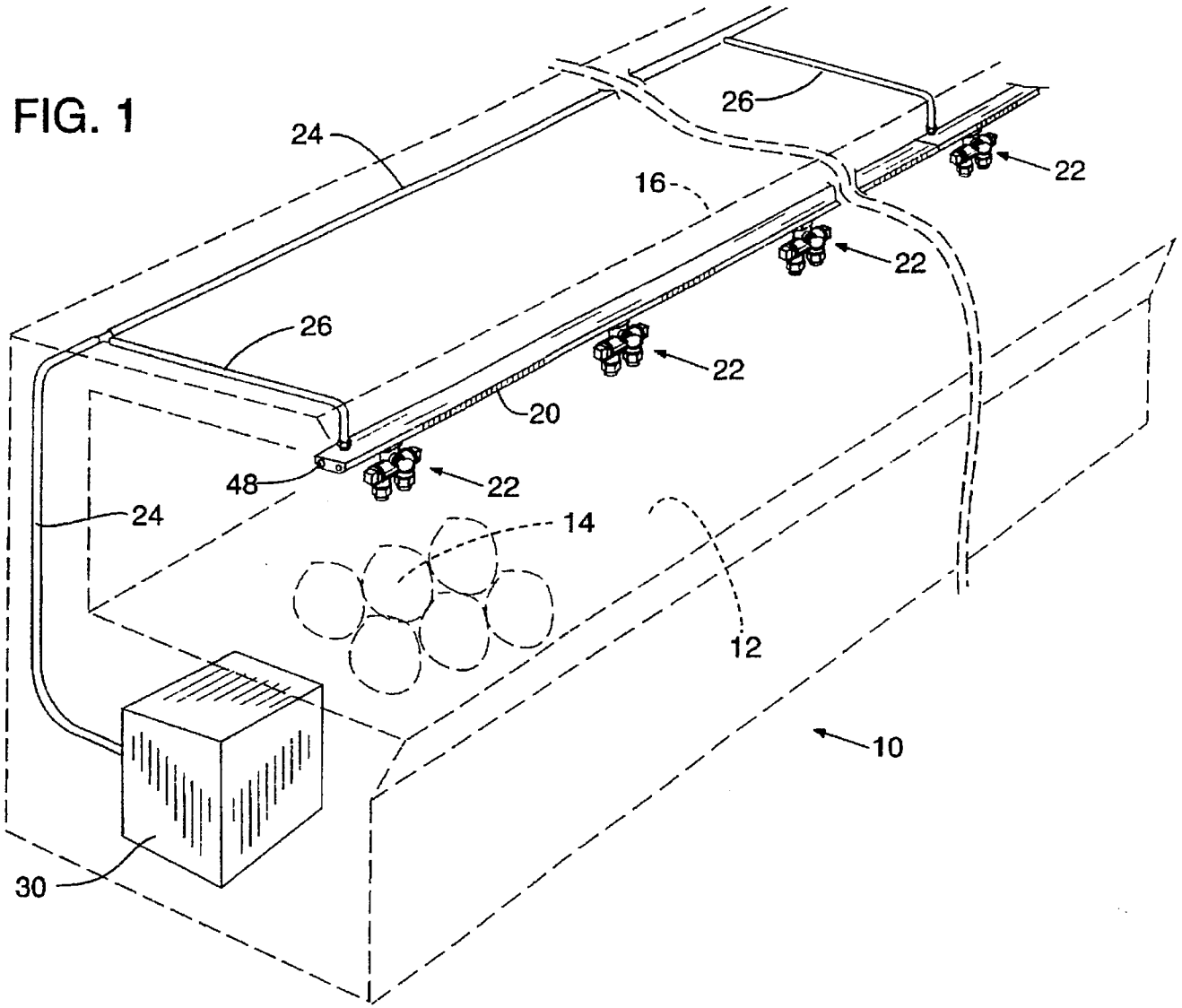
FIG. 1 is a view of a produce display case incorporating a produce mister of the present invention.

Refer now to FIG. 1 of the drawings which illustrates a typical display case 10 for displaying fresh produce 14. The display case 10 has a shelf 12 for displaying produce 14 and is at a convenient height for shoppers. The shelf 12 of the display case 10 has a depth so that any of the produce 14 that is displayed on the shelf 12 is readily accessible to a shopper, Most often the display case 10 has a sufficient width to display many varieties of produce, The display case in this embodiment has a projecting top 16 that projects over the shelf 12 of the case 10. The top 16 supports the lighting equipment that is utilized to illuminate the produce 14 on the shelf 12 and the top also supports the produce mister of the present invention. The produce mister of the present invention is arranged to supply a water mist onto the produce at selectable time cycles, The selectable cycles control the time duration that the water mist is dispensed and the elapsed time between the dispensing of the water mist.

As shown, a mist bar 20 is mounted to the top 16 and extends along the width of the produce case 10. Misting nozzles 22 are mounted to the mist bar 20 at select intervals. Water is supplied to the mist bar 20 and thus to the nozzles 22 by branch lines 26 extending from a main water line 24. The branch lines 26 are connected to the mist bar 20 at selected intervals. The flow of water through the water line 24 and the branch lines 26 to the mist bar 20 is controlled by a known control unit 30. The control unit 30 includes a control valve that will control the cycling of water on and water off and may be set to a desired time cycle. A typical selectable setting would control the flow of water for a time period of 10 seconds at 10 minute intervals. The control unit 30 most often also includes filters to filter the water that will flow through line 24 and may include an optional pump to maintain the water pressure.

As previously mentioned, one of the problems with the misting devices is the lack of purging of fresh water through the lines during the mist cycle. The produce mister of the present invention utilizes conduits having a relatively small cross sectional area such that during a mist cycle, all of the water in the conduit is utilized and thus fresh water is always delivered to the nozzle assembly 22. As shown in the figure, multiple branch lines 26 are incorporated to supply water to the mist bar 20. The multiple branches 26 alleviate the inherent pressure drop experienced when fluid flows at a relatively high rate through a conduit having a small cross sectional area.

In one embodiment of the present invention, the main water line 24 is of ⅜" diameter tubing and the branch lines 26 are of ¼" diameter tubing. The conduit 50 within the mist bar 20 is on the order of 5/32" diameter and preferably has a somewhat elliptical shape. The arrangement of the small diameter conduit within the mist bar 20 assures that all of the water in the mist bar 20 will be purged, that is utilized, during a mist cycle and, therefore, a fresh supply of water is always ready to be dispensed through the nozzle assemblies 22. It is preferable to have the branch lines 26 connected to the mist bar 20 at twelve foot intervals to insure an adequate flow during a mist cycle.

Figure 2:
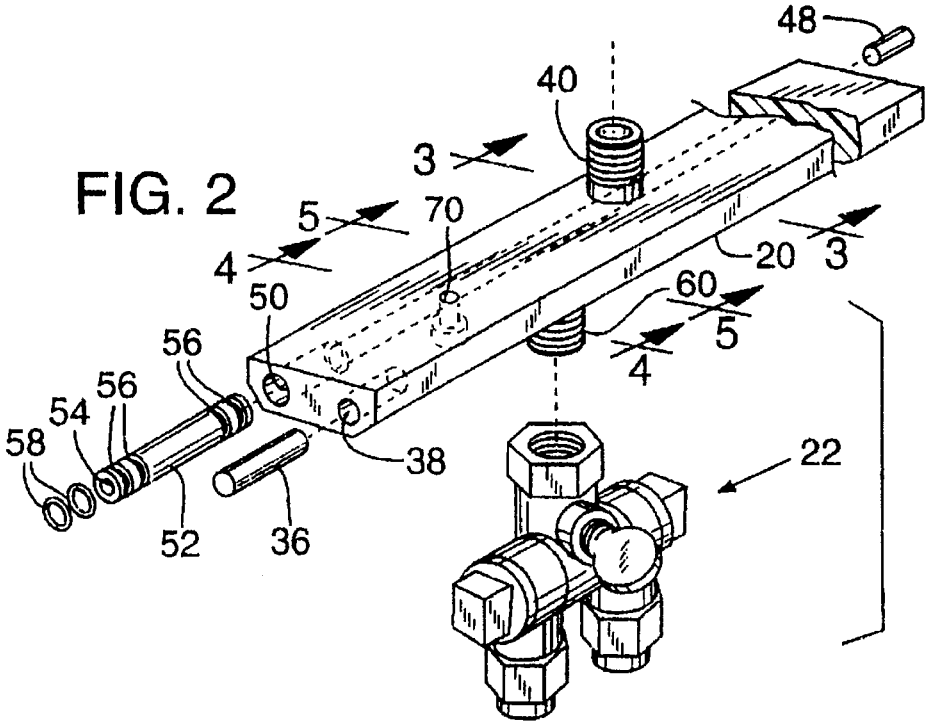
FIG. 2 is a view of a portion of the misting bar of the produce mister of FIG. 1.

FIG. 2 further illustrates a portion of the mist bar 20 to show the connecting arrangement for connecting one mist bar 20 to another, to show the connection for water input to the mist bar 20 and to show the mounting arrangement of the nozzles 22 to the mist bar 20.

A nipple (connector) 40 is provided to facilitate connecting the mist bar 20 to the branch line 26. The nipple 40 is mounted in a bore 42 of the mist bar 20 and communicates with a conduit 50 within the mist bar 20. Another nipple (connector) 60 is mounted in a bore 62 of the mist bar 20 that also communicates with the conduit 50 and is provided for mounting the nozzle assembly 22.

Figure 3:
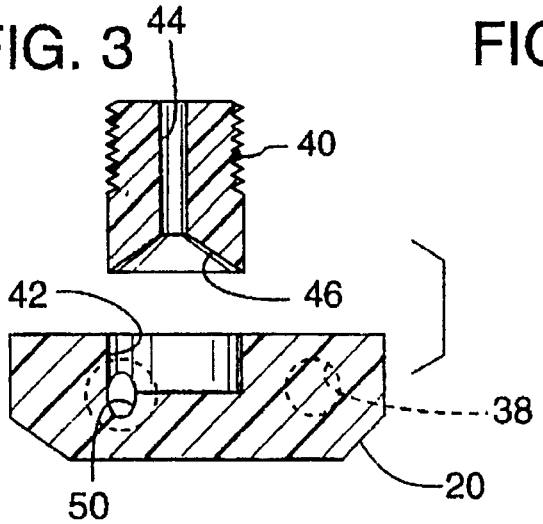
FIG. 3 is a view of the misting bar of FIG. 2 as viewed on view lines 3—3 illustrating the mounting of a water line nipple.

FIG. 3 illustrates the mounting arrangement of the nipple (connector) 40 in a bore 42 in the mist bar 20. The nipple 40 is provided to facilitate connecting a branch line 26 to the mist bar 20. As shown, the bore 42 is of sufficient depth to intersect the conduit 50. The nipple 40 is secured in the bore 42 in a conventional manner such as by a known adhesive. The bore 44 in the nipple 40 has a flared or tapered end 46 to provide an unrestricted flow of water through the nipple 40 and into the conduit 50. It is preferable to have a branch line 26 connected to the mist bar at spaced intervals to insure adequate pressure and flow of water through the conduit 50 of the mist bar 20.

Figure 4:
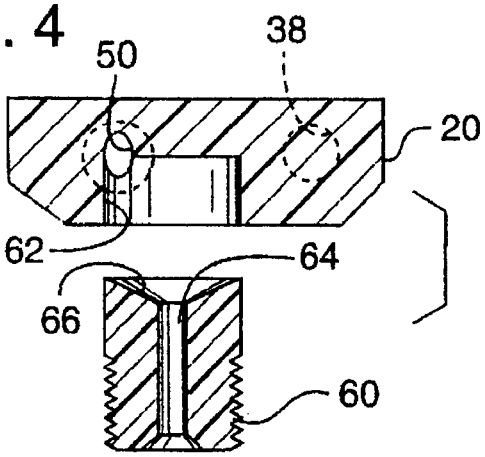
FIG. 4 is a view of the misting bar of FIG. 2 as viewed on view lines 4—4 illustrating the mounting of a nozzle nipple.

FIG. 4 illustrates the arrangement for mounting the nipple (connector) 60 to the mist bar 20. The nipple 60 is mounted to the mist bar on the opposite side of the nipple 40 and is provided to mount the nozzle assemblies 22. The nipple 60 is mounted in a bore 62 that communicates with the conduit 50 of the mist bar 20. The nipple 60 is secured in the bore 62 in a conventional manner such as by a known adhesive. The bore 64 in the nipple 60 has a flared end 66 to provide unrestricted water flow from the conduit 50 through the nipple 60 and into the nozzle assembly 22. The nipples 60 are mounted at spaced intervals to provide a desired misting pattern on the produce 14 that is on the shelf 12 of the case 10.

Referring again to FIG. 2, the conduit 50 extends along the length of mist bar 20 and as previously mentioned, has a small cross sectional area. One section of mist bar 20 is coupled to another section of mist bar 20 by a coupling 52 and a pin (dowel) 36. The coupling 52 is arranged to fit in the ends of the conduit 50 of each of the mist bars 20 that are to be interconnected. The coupling 52 thus connects one conduit 50 of one mist bar 20 to the conduit 50 of the other mist bar 20. As shown, the coupling 52 has a through bore 54 for the passage of water therethrough and has external grooves 56 for receiving O-rings 58. The O-rings 58 provide a seal to prevent leakage of water at the juncture of the mist bars. A bore 38 that is substantially parallel to the conduit 50 is provided in the mist bar 20 for receiving an end of the pin 36. The bore 38 is provided in each end of the mist bar 20 and has sufficient depth to exceed the half length of the pin 36. One section of mist bar 20 may thus be coupled to another section of mist bar 20 by simply inserting a coupling 52 with O-rings 58 mounted in the grooves 56 into an end of the conduit 50 of one bar and inserting a pin 36 into the bore 38 of the same section of mist bar 20. Another section of mist bar 20 is simply aligned such that its conduit 50 will receive the extended end of the coupling 52 and its bore 38 will receive the extended end of the pin 36. The conduit 50 on the end of the mist bar 20 that is not connected to another mist bar is simply closed by inserting and securing a plug 48, as by adhesive bonding, into the open end of the conduit 50.

Figure 5:
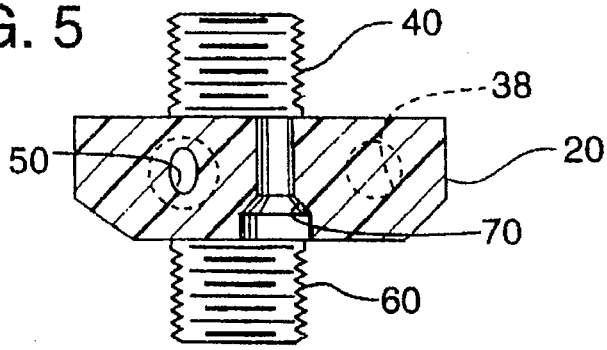
FIG. 5 is a view of the misting bar of FIG. 2 as viewed on view lines 5—5 illustrating the mounting hole for a fastener.

FIG. 5 illustrates the mounting holes or bores 70 that are provided at intervals along the length of the mist bar 20 to facilitate mounting the mist bar to a device such as the top 16 of the case 10 of FIG. 1. The bore 70 is a through bore and is preferably counter sunk to receive a conventional fastener such that the head of the fastener will be flush with the surface of the mist bar 20.

Those skilled in the art will recognize that variations and modifications may be made without departing from the true spirit and scope of the invention. The invention is therefore not to be limited to the embodiments described and illustrated but is to be determined from the appended claims.

What is claimed is:

1. A system for misting produce in a display case having an extended width wherein produce is displayed, said system comprising:

a water line providing a source of water along the width of the display case and a water supply providing water under pressure to the water line;

a misting bar extended the width of the display case, a conduit provided through the misting bar and a connecting line between the water line and misting bar for connecting the conduit to the water supply, and nozzles connected at frequent intervals to the conduit for spraying water mist on produce displayed in the display case; and said conduit of said misting bar having a small diameter and multiple connecting lines at multiple connections along the length of the misting bar connecting the misting bar to the water line to maintain water pressure in the conduit and accordingly the desired misting action through the nozzles.

2. A system as defined in claim 1 wherein the conduit inside diameter is less than ½".

3. A system as defined in claim 2 wherein the conduit inside diameter is about 5/32".

4. A system as defined in claim 1 wherein the width of the display case, length of water line and length of the misting bar exceeds 12 feet, said connecting line between the water line and misting bar provided at no less than 12 foot intervals along the length of the bar.

5. A system as defined in claim 1 wherein a control controls the frequency and duration of misting cycles and wherein the quantity of water sprayed into the display case in a single misting cycle exceeds the quantity of water contained in the conduit of the misting bar.

6. A system as defined in claim 1 wherein the misting bar is produced for interconnected sections, and a coupling extended between the bar sections at the conduit to seal the junctures of the conduits against leakage.

7. A system as defined in claim 6 wherein bores are provided in the bar that intersect with the conduit, and connectors seated in the bores to provide connection to the water line and nozzles.

8. A system as defined in claim 6 wherein said coupling has peripheral end grooves and O-rings in the grooves to insure sealing of the coupling in the conduit of the bar sections.

9. A system as defined in claim 6 wherein said coupling facilitates mechanical connection of the bar sections and dowels additionally spanning the junctures of the bar sections to complete the mechanical connection.

10. A system for misting produce in a display case having an extended width wherein produce is displayed, said system comprising:

a water line providing a source of water along the width of the display case and a water supply providing water under pressure to the water line;

a misting bar extended the width of the display case, a conduit provided through the misting bar and a connecting line between the water line and misting bar for connecting the conduit to the water supply, and nozzles connected at frequent intervals to the conduit for spraying water mist on produce displayed in the display case; and the misting bar is produced from interconnected sections, and a coupling extended between the bar sections at the conduit to seal the junctures of the conduits against leakage.

11. A system as defined in claim 10 wherein said coupling has peripheral end grooves and O-rings in the grooves to insure sealing of the coupling in the conduit of the bar sections.

12. A system as defined in claim 11 wherein said coupling facilitates mechanical connection of the bar sections and dowels additionally spanning the junctures of the bar sections to complete the mechanical connection.

* * * * *